US005318646A

United States Patent [19]

Cardini et al.

[11] Patent Number: 5,318,646

[45] Date of Patent: Jun. 7, 1994

[54] METHOD AND APPARATUS FOR JOINING ENDS OF WEBS OF WELDABLE FILM, FOR THE FORMATION OF BAGS AND THE LIKE

[75] Inventors: Giuseppe Cardini, Florence; Ugo Chiti, Pistoia, both of Italy

[73] Assignee: Garibaldo Ricciarelli S.r.l., Pistoia, Italy

[21] Appl. No.: 710,763

[22] Filed: Jun. 4, 1991

[30] Foreign Application Priority Data

Jun. 6, 1990 [IT] Italy ..... 9416 A/90

[51] Int. Cl.[5] ..... B65H 19/20

[52] U.S. Cl. ..... 156/157; 156/504; 156/507; 242/58.2; 242/58.4

[58] Field of Search ..... 156/157, 159, 502, 504, 156/507; 242/58.1, 58.2, 58.3, 58.4, 58.5

[56] References Cited

U.S. PATENT DOCUMENTS

| | | | |
|---|---|---|---|
| 2,035,682 | 3/1936 | Wikle | 242/58.4 |
| 3,384,527 | 5/1968 | Fener | 156/515 X |
| 3,610,547 | 10/1971 | Anderson | 156/515 X |
| 3,627,616 | 12/1971 | Davis | 156/507 X |
| 4,629,531 | 12/1986 | Kataoka | 242/58.4 X |
| 4,668,328 | 5/1987 | Kyytsönen | 156/502 |
| 4,842,681 | 6/1989 | Bader et al. | 242/58.4 X |
| 4,881,695 | 11/1989 | Beisswanger | 156/502 X |
| 5,006,385 | 4/1991 | Cheung et al. | 156/157 X |

FOREIGN PATENT DOCUMENTS

| | | | |
|---|---|---|---|
| 48-23552 | 7/1973 | Japan | 156/157 |
| 48-23553 | 7/1973 | Japan | 156/157 |
| 55-73522 | 6/1980 | Japan | 156/507 |

*Primary Examiner*—David A. Simmons
*Assistant Examiner*—Mark A. Osele
*Attorney, Agent, or Firm*—McGlew and Tuttle

[57] ABSTRACT

For the continuous formation of bags for containing bulk materials—in the form of granules, powders and the like—the end of the web (EN), from a new bobbin (BA) in readiness, is laid, with the surface to be welded on the outside, around a welding bar (18) carried by a movable element (12), and the bar (18) is positioned opposite a counterbar (20), along which the web (N) being exhausted from the previous bobbin (B) runs; bar and counterbar are brought close to one another to carry out transverse welding and cutting, in such a manner that a superimposed and welded edge (BS) emerges transversely from the continuous web thus joined, from the surface opposite that of welding. (FIG. 2)

13 Claims, 4 Drawing Sheets

METHOD AND APPARATUS FOR JOINING ENDS OF WEBS OF WELDABLE FILM, FOR THE FORMATION OF BAGS AND THE LIKE

FIELD AND BACKGROUND OF THE INVENTION

The invention relates to a method and an apparatus for making a joint between ends of webs made of weldable material, intended for the formation of bags for containing bulk material in general, and in particular (but not exclusively) food products in grains or small pieces or in the form of powder. The webs in such cases are expediently to be welded by means of corresponding surfaces, that is to say the two surfaces intended generally to be internal or the two surfaces intended to be external in the finished bag. In the two bobbins—that being exhausted and the new one—such surfaces are oriented in the same direction.

SUMMARY AND OBJECTS OF THE INVENTION

The invention makes it possible to carry out rapidly cutting and welding of the ends to be joined, in the correct mutual position. These and other aims and advantages will become clear from the following text.

A first subject of the invention is a method for joining ends of webs of material made of weldable film, as indicated above. According to this method, the end of the web, from a new bobbin in readiness, is laid around one of the two components of a transverse welding group, with the surface to be welded on the outside. The other of the two components is brought close to the surface opposite that to be welded of the web being exhausted from the previous bobbin, and the two components of the welding group are brought close to one another in order to carry out transverse welding and cutting, in such a manner that a superimposed and welded edge emerges transversely from the continuous web thus joined, from the surface opposite that of welding.

A further subject of the invention is an apparatus for making a joint between ends of webs made of film of weldable material, which essentially comprises a combination of:

a work position for a first, unwinding bobbin, and a position of readiness for a second bobbin arranged for replacement;

guide means for the web unwinding with a trajectory not far from the second bobbin;

a movable element with a bar for transverse welding, constituting a first of the two components of a welding group, capable of being displaced adjacently to the second bobbin and of receiving from it, laid around the bar itself, the end with the weldable surface on the outside and turned towards the weldable surface of the web unwinding along the trajectory;

an opposing bar or counterbar, constituting a second transverse bar component, arranged on the side opposite the bar, in relation to the trajectory of the unwinding web;

and means for bringing close the bar and the counterbar in order to weld and to cut transversely the double thickness of web material situated between them.

The movable element can be developed in the form of a portal with arms articulated about an axis parallel to the axes of the bobbins and connected by said the bar. The bar, in a position removed from that of welding, positions itself to receive the end of the second bobbin in the position of readiness with the weldable surface on the outside.

The counterbar also can be movable towards and away from the trajectory of the web, synchronously with the bar.

The apparatus can comprise guide means between the two positions of readiness and of work, for the transfer of a bobbin to the work position, after lowering of the bar element in the space between said guide means.

The invention will be understood more clearly by following the description and the attached drawing, which shows a non-limiting exemplary embodiment of the invention itself and in which:

DETAILED DESCRIPTION OF THE PREFERRED EMBODIMENTS

Figure 1:
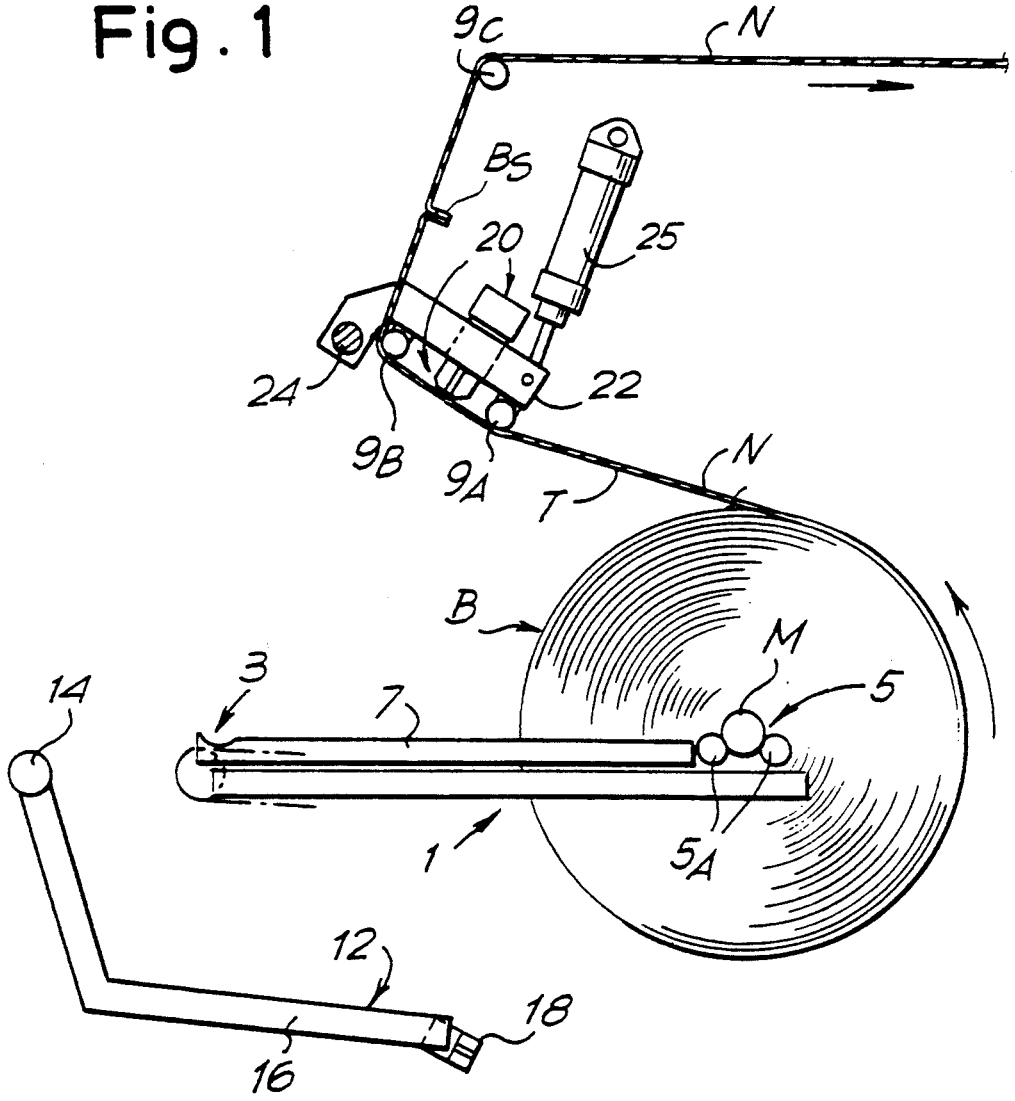
FIGS. 1, 2, 3 and 4 show diagrammatically a vertical longitudinal cross-section of the machine in four successive stages of a cycle of operation for replacement of the bobbin and joining the webs.

According to what is illustrated in the attached drawings, a structure 1 forms a seat 3 for a position of readiness and a seat 5 for a work position. The latter at least being defined by rotary rollers 5A, on which the hub M of a bobbin in the work position can rotate for the distribution of the web N towards the utilization, and in particular towards a packaging machine for the formation of bags which—immediately after formation—are filled with bulk material (such as food products), then to be closed, in particular welded. Between the position 3 and the position 5, the structure 1 forms guide means 7 which can be sliding means—with chain drive—for maning the projecting ends of the hub M of the bobbin B. Elements 9A, 9B, 9C indicate some of the guide means for the web N which is fed from the bobbin B and made to run along a trajectory T towards the packaging machine or other utilization.

A second bobbin BA, which is to replace the first bobbin B after the latter has been exhausted, can be positioned in a position of readiness 3. The final end of the web of the first bobbin B and the beginning of the web of the second bobbin BA, which is in the position of readiness, are to be welded to one another.

Webs of film, which are especially intended for the packaging of food products or the like, generally have an internal surface which is weldable and an external surface which generally is not, or is not easily, weldable. The apparatus forming the subject of the invention makes possible welding between the weldable surfaces of the web which are generally the internal surfaces of a bag and which in any case are the surfaces of the web which are turned towards the bobbin and for example, therefore, the lower surfaces of the web N unwinding from the bobbin B in FIG. 1 and, correspondingly, the surface which faces the bobbin of the end EN of the web of the second bobbin BA in the position of readiness (see FIG. 2).

In order to carry out welding with rapid operation between the end of the web of the bobbin B being exhausted (see FIG. 2) in the position 5 and the front end EN of the web of the second bobbin BA in the position of readiness 3, the apparatus described below is provided.

This apparatus comprises an element 12 which is movable angularly about an articulation 14 with an axis parallel to the axis of the bobbins B and BA. The movable element 12 is developed in the form of a portal with arms 16 articulated at 14 and a bar 18 which connects the movable ends of the portal structure of the element 12 and which constitutes one of the two components of the welding group. The element 12 is capable of being displaced from a lowered position 18X below the guides 7 to a raised welding position, passing between the two guides 7 which support the hub M of the bobbin during the transfer between the two positions. The element 12 can be considered a movement means of the first component of the welding group.

Figure 2:
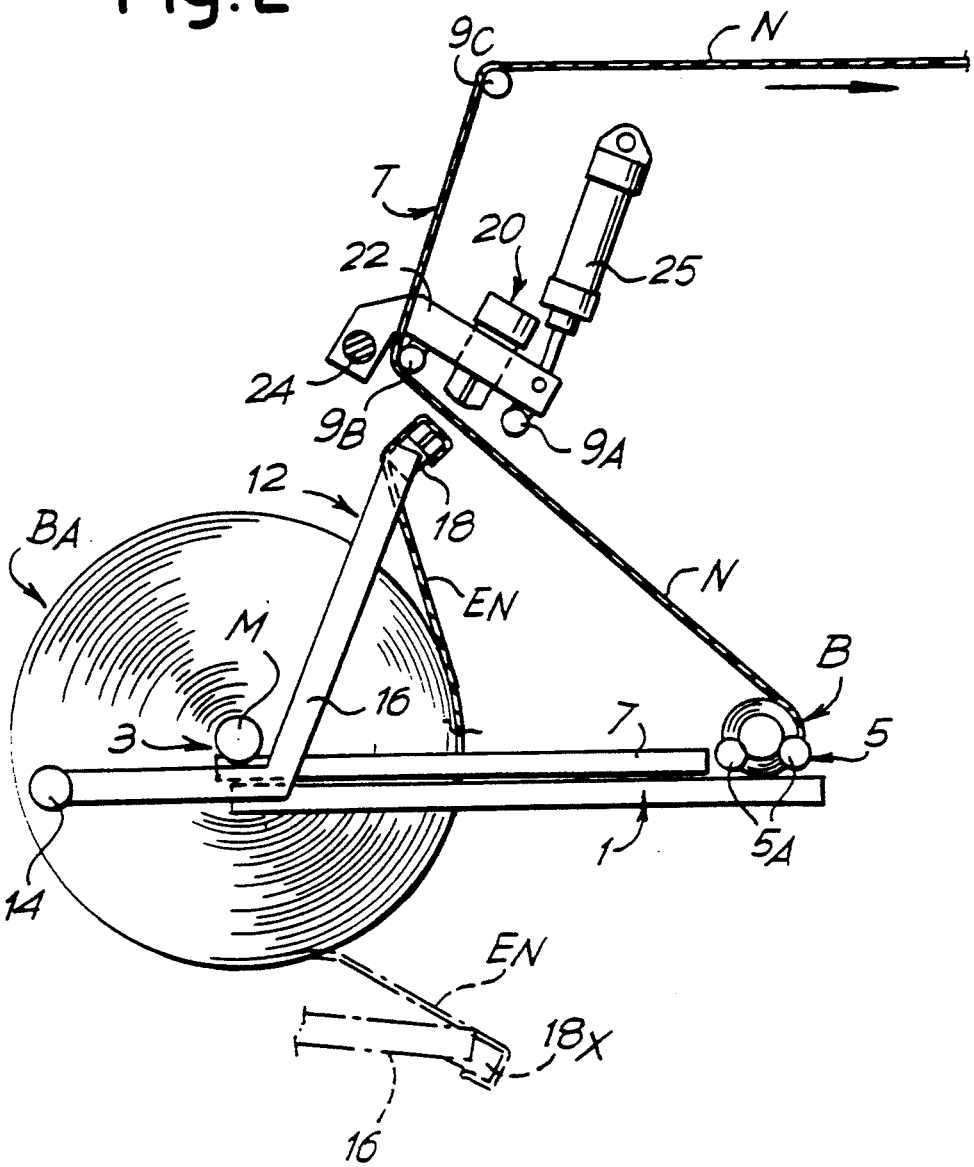
Figure 3:
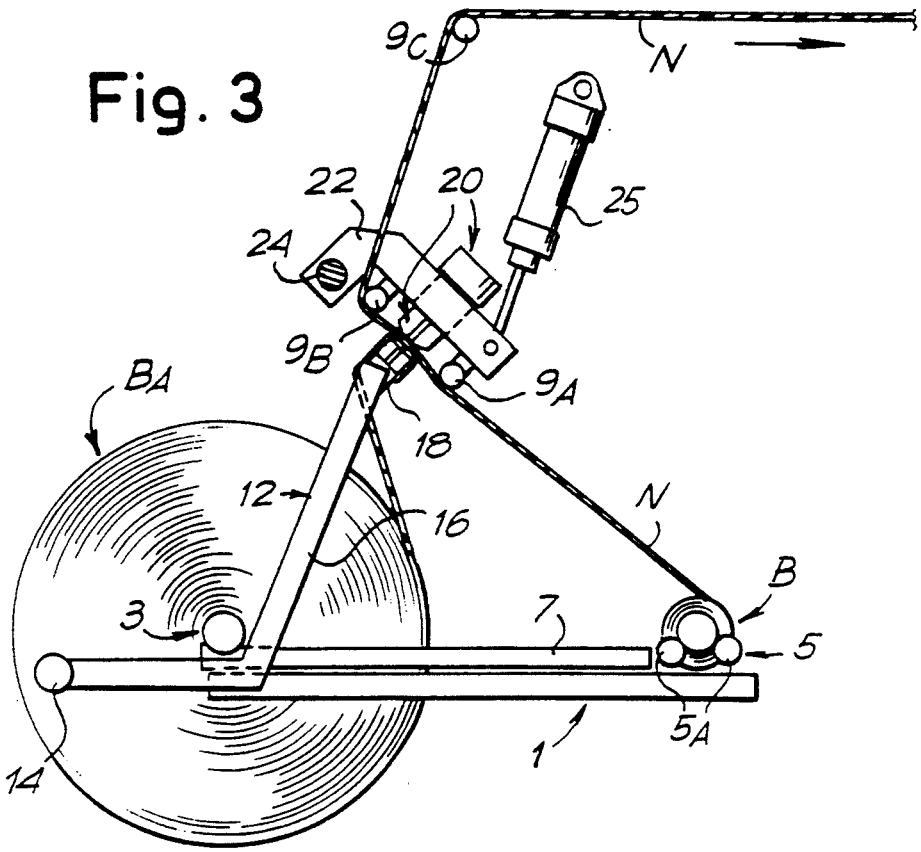

The other component of the welding group comprises a counterbar 20 which is carried by arms 22 articulated at 24 about an axis which is also parallel to the axes of the bobbins installed in the positions. The entire counter bar 20 and arms 22 assembly is controllable by means of an actuator, for example 25. In relation to the trajectory T of the unwinding web, which is defined by the guide means 9A, 9B, 9C or equivalents, the two components of the welding group (12, 16, 18 and 20, 22, 24 respectively) are situated on opposite sides and can be displaced into the active position of approach of the bar 18 to the counterbar 20 as shown in FIG. 3, reaching beforehand the almost contraposed position shown in FIG. 2.

Figure 5:
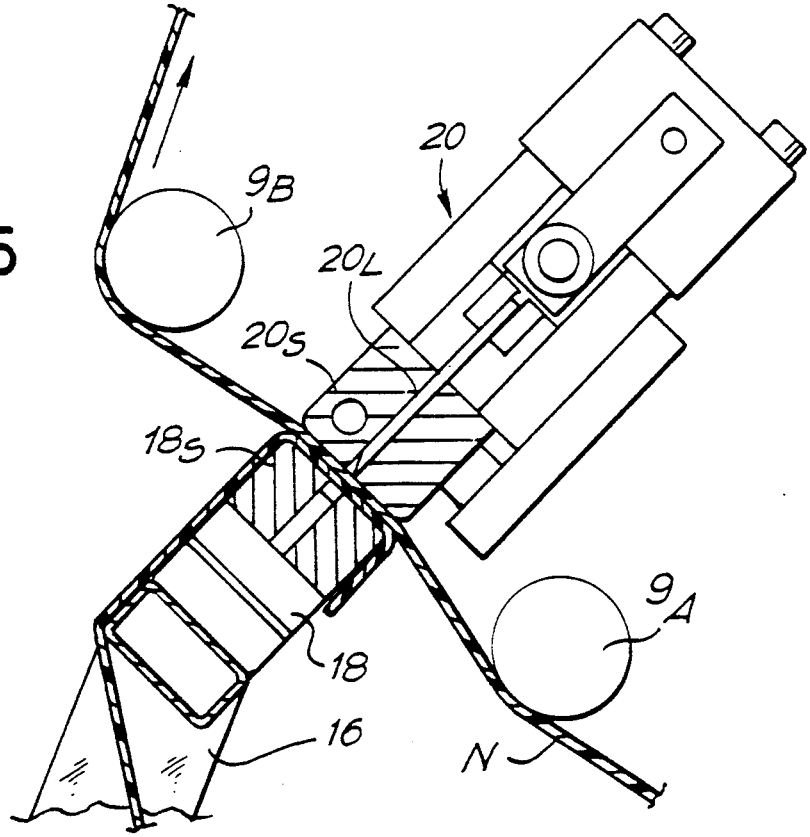
FIG. 5 shows a detail of the bar and the counterbar for welding.

In the state indicated in FIG. 1, the first bobbin B in the work position 5 unwinds the web which is drawn expediently along the trajectory T. The positions of readiness 3 is available to receive a second bobbin BA to be arranged to continue the distribution essentially continuously. The front end EN of the web on the bobbin BA, located in the position of readiness 3, is wound around the bar 18 which is situated in the lowered position 18X of readiness as shown by way of indication in FIG. 2 in FIG. 1. The arrangement of the end EN on the bar 18 can also be carried out after raising from the position 18X to the position shown. When the first bobbin B is being exhausted as shown in FIG. 2, the element 12 is raised from the position in FIG. 1 to the position in FIG. 2 so as to bring the welding bar 18 from the position 18X to the position shown in FIG. 2 which is essentially contraposed to the counterbar 20. The end EN wound on the bar 18 has its welding surface facing the welding surface of the web N coming from the bobbin B. By bringing the counterbar 20 close to the bar 18, and possibly with a corresponding displacement of the guide means 9A and 9B, the welding and the cutting is brought about of the double thickness of material which remains between bar and counterbar. As can be seen in particular in FIG. 5, the active welding portion of the bar 18 is that indicated by 18S, while 20S indicates the corresponding active welding part of the counterbar 20. The latter also comprises a cutting blade 20L which at the right time brings about the cutting of the two thicknesses upstream of the weld carried out by the portions 20S, 18S, in relation to the direction of displacement of the web. As a result, the double thickness of the edges welded to one another, which are adjacent to the cut effected by the blade 20L, is capable of ensuring the continuity of the final end of the web coming from the bobbin B and the beginning of the web coming from the bobbin BA. From the welding condition indicated by FIG. 3, distribution is brought about from the bobbin BA. The front end EN of the web on bobbin BA is welded by means of the double welding edge BS to the end of the web previously unwound from the bobbin B, the residue of the weld id discarded.

Figure 4:
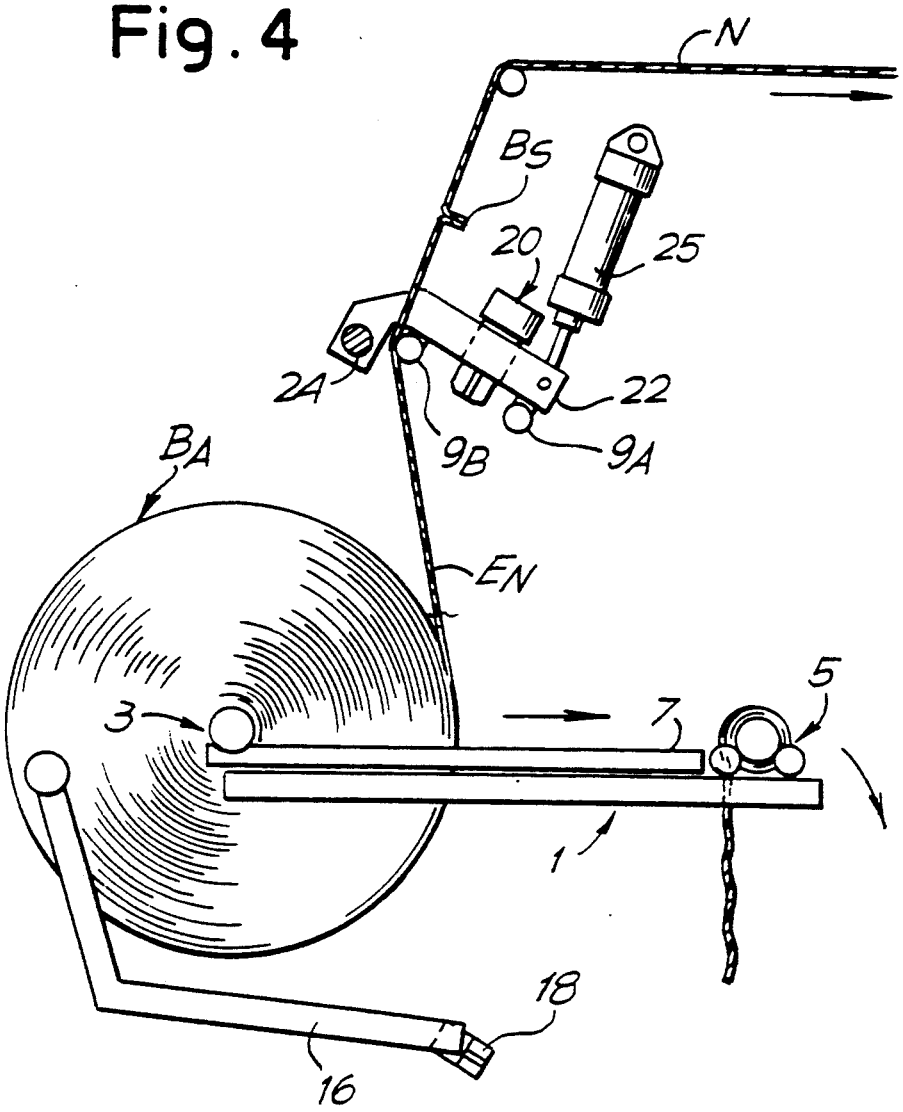

From the state in FIG. 4, the state in FIG. 1 is reached, having brought about the disposal of the empty bobbin from the work position 5 and the displacement of the bobbin BA from the position 3 of readiness to the work position 5 by sliding or rolling along the guide means 7. The state in FIG. 1 is thus reached once again with a replaced bobbin.

It is clear that it is possible by means of this arrangement to bring about essential continuity in the distribution of the web upon replacement of an exhausted bobbin by a new bobbin. This apparatus is particularly suitable for the uses mentioned above.

It is intended that the drawing only show an exemplary embodiment which is given only by way of practical demonstration of the invention, it being possible for the invention to vary in form and arrangement without moreover leaving the scope of the idea which forms the invention itself. Any presence of reference numbers in the enclosed claims has the purpose of facilitating reading of the claims with reference to the description and to the drawing, and does not limit the scope of protection represented by the claims.

We claim:

1. An apparatus for joining webs, the apparatus comprising:

work seat means for supporting a first bobbin in a work position;

waiting seats means for supporting a second bobbin in a waiting position;

guide means for guiding a first web from said first bobbin along a trajectory passing adjacent said second bobbin in said waiting position;

welding means for welding said first web from said first bobbin to a second web from said second bobbin, said welding means including a first component and a second component, said first component having means for receiving an end of said second web and for laying a weldable surface of said second web around said first component in a direction facing a weldable surface of said first web, said second component being positioned on a side of said trajectory opposite said first component;

first component movement means for moving said first component towards and away from said second component of said welding means, said first component movement means including an arm pivotable about an axis substantially parallel to an axis of said second bobbin, said arm being connected to said first component of said welding means, said arm being movable between a first position with said first component positioned adjacent said second component and a second position with said first component spaced from said second component, said first position of said arm being arranged between said waiting position and said working position, said blocking a transfer path of said second bobbin from said waiting position to said working position, said second position of said arm being spaced away from said transfer path and allowing movement from said waiting position to said working position;

cutting means positioned adjacent said welding means and for cutting said first web;

guiding and transfer means for transferring and guiding said second bobbin from said waiting position to said working position after said arm has moved toward said second position.

2. An apparatus according to claim 1, wherein:

said arm moves said first component of said welding means during moving of said second bobbin to said waiting position.

3. An apparatus according to claim 1, wherein:

said weldable surface of said first and second webs is directed inward on said first and second bobbins respectively.

4. An apparatus according to claim 1, further comprising:

welding movement means connected to said welding means and for moving said first component and second component of said welding means together.

5. An apparatus according to claim 1, further comprising:

second component movement means for moving said second component of said welding means towards said first component of said welding means when said arm is in said first position.

6. An apparatus according to claim 1, wherein:

said first component movement means includes another arm and is in the form of a portal.

7. An apparatus according to claim 1, wherein:

said guiding and transfer means moves said second bobbin after said welding means welds said first and second webs together.

8. An apparatus according to claim 1, wherein:

said first component movement means moves said first component of said welding means into a welding position while said second bobbin is in said waiting position.

9. A method for joining ends of webs of material, the method comprising the steps of:

placing a first bobbin with a first web in a work position;

unwinding said first web from said first bobbin;

moving a second bobbin having a second web with a free end into a waiting position, said waiting position being spaced from said work position;

providing a welding and cutting unit including a first component and a second component;

providing an arm connected to one end to said first component of said welding and cutting unit, said arm being pivotable between a first position and a second position;

laying said free end of said second web of said second bobbin around said first component of said welding and cutting unit, a surface of said second web to be welded being faced radially outward from said first component;

pivoting said arm from said second position to move said first component of said welding and cutting unit adjacent to said wedable surface of said first web unwound from said first bobbin and in front of said second component, said pivoting from said second position to said first position passing said first component between said waiting position and said working position and arranging said arm between said waiting position and said work position to block a transfer path of said second bobbin from said waiting position to said work position, said second component being arranged on an opposite side of said first web from said first component;

moving together said first and second components when a predetermined amount of said first web remains on said first bobbin;

welding together portions of said first web and said second web positioned between said first and second components;

cutting off said predetermined amount of said first web after said welding;

pivoting said arm from said first position to said second position after said welding and cutting, said second position moving said arm out of said transfer path and allowing said second bobbin to move from said waiting position to said work position;

removing said first bobbin from said work position after said cutting;

moving said second bobbin from said waiting position to said work position; and moving a new bobbin into said waiting position.

10. A method in accordance with claim 9, wherein:

said surface of said second web to be welded is positioned on a side of said free end of said second web substantially opposite said first component of said welding and cutting unit.

11. A method in accordance with claim 9, wherein:

said moving of said second bobbin from said waiting position to said working position is performed after said welding.

12. A method in accordance with claim 9, wherein:

said removing of said first bobbin from said position, said moving of said second bobbin to said waiting position, and said moving of said second bobbin from said waiting position to said work position, are all performed independently.

13. A method in accordance with claim 9, wherein:

said welding is performed when said first bobbin is in said working position and said second bobbin is in said waiting position.

* * * * *